United States Patent [19]

Galiano

[11] Patent Number: 4,674,186

[45] Date of Patent: Jun. 23, 1987

[54] SCOOP SCRAPER TOOL

[76] Inventor: Philip S. Galiano, 1 Graham Ave., Metuchen, N.J. 08840

[21] Appl. No.: 878,011

[22] Filed: Jun. 24, 1986

[51] Int. Cl.[4] ..... B26B 3/00

[52] U.S. Cl. ..... 30/169; 15/236 K; 30/136; 30/328

[58] Field of Search ..... 30/136, 136.5, 169, 30/328, 327, 324, 172; 15/93 R, 236 R

[56] References Cited

U.S. PATENT DOCUMENTS

| | | | |
|---|---|---|---|
| 1,367,032 | 2/1921 | Ferdon | 30/136 |
| 2,807,168 | 9/1957 | Wipf | 15/236 R X |
| 4,574,417 | 3/1986 | Magnasco | 15/236 R |
| 4,627,128 | 12/1986 | Shea | 15/236 R |

*Primary Examiner*—Douglas D. Watts

*Attorney, Agent, or Firm*—Anthony J. DeLaurentis

[57] ABSTRACT

A tool having a handle and a blade secured to and extending generally longitudinally from the handle is adapted for removing the contents of and scraping clean a container for liquid, semi-liquid, semi-solid or solid materials. The tool is rigid and inflexible and the blade is provided with a scoop-like member at the end thereof which is remote from the handle. The blade is also provided with separate scrapers edges which are adapted from scraping the bottom and side walls of the container.

16 Claims, 6 Drawing Figures

SCOOP SCRAPER TOOL

BACKGROUND OF THE INVENTION

1. Field of the Invention

This invention relates to a hand held tool for removing the contents of and scraping clean a container for liquid, semi-liquid and/or solid materials. More particularly, this invention relates to a hand held tool which is designed for removing, scraping, scooping and/or cleaning the contents of a container, usually but not limited to metal or plastic pails or buckets, tubs or tins, or the like of various sizes and shapes.

2. Prior Art

The removal of residual material from a container has been a difficult problem to solve. For example, when one wishes to remove residual liquid material, such as paint, from a can, the can usually is turned upside down to pour the paint from the can. While this works reasonably well, most paint cans are provided with a lip that prevents complete pouring of the paint from the can.

An even more difficult problem is witnessed when one attempts to remove residual semi-liquid or semi-solid materials, such as jelly, butter, joint compound, ready mixed mortar, and the like from their containers. In such cases simply turning the container upside down will not cause the semi-liquid material to drain therefrom.

Accordingly, there have been a number of tools developed for the sole purpose of removing residual material from a container. Such tools have included various putty knives, spoons, scoops, trowels, spatulas, scrapers, and the like, and many of these tools have been patented. For example, U.S. Pat. No. 755,521 discloses a hand tool for cleaning tins, pots and other vessels and utensils. The tool is comprised of a wooden handle and a hard rubber scraper having three edges, two of which are straight, forming a right angle at the point where they meet, and the other being in the form of an arc.

U.S. Pat. No. 302,813 discloses a butter ladle which is comprised of an elongated handle and a blade portion which is attached to the handle and which is convex on its back face and concave on its front face. The tool is particularly adapted to remove butter from the edges and corners of a churn.

Still other scraping or scooping devices are disclosed in U.S. Pat. Nos.: 1,704,329; 2,012,637; 2,319,870; 2,817,867; 2,935,758; 4,159,839; 4,447,927 and 4,355,432. The devices of these patents have been designed to scrape or scoop various cooking and baking vessels, paint cans, gutters, boat hulls and the like; and while each of these patented devices is somewhat useful, there exists a need for still improved hand tools which can be used to facilitate the essentially complete removal of a variety of liquid, semi-liquid and/or semi-solid materials from conventional containers.

SUMMARY OF THE INVENTION

The present invention satisfies the aforesaid need by providing an improved hand tool which can be used in a variety of applications for removing, scraping, scooping and/or cleaning the residual material which accumulates or otherwise adheres on the bottom, sides and edges of the container in which the material is stored. To this end, the tool of the present invention is adapted to be hand held and includes a generally longitudinally extending handle having a blade means rigidly connected thereto. The blade means extends longitudinally relative to the handle and is of length which is dictated by the particular application for which it is intended. However, regardless of whether the tool is to be used for cleaning a deep or a shallow container, and regardless of its length, the blade means comprises several cooperating elements including a first elongated member having a generally arcuate or crescent-shaped cross section. This first arcuate member defines a trough for receiving and carrying the material to be removed from its container. The blade means also comprises a flat strip or scraping edge which is rigidly connected along one longitudinal edge of the first arcuate member and which functions to scrape residual material from the side walls of the container. Along the other edge of the first arcuate member, adjacent to the end thereof which is remote from the handle, there is provided a second arcuate member which functions as an extension of the first arcuate member so as to enlarge the surface area of the trough at the end of the tool remote from the handle. A flat plate member is also provided at the remote end of the blade means. This flat member functions as both a scraper for removing material from the bottom of the container and as a wall member that cooperates with the first and second arcuate members to define a scoop-like member at the remote end of the blade means. The flat plate member which is disposed transversely to the longitudinal extension of the handle and blade means, may be formed as a contiguous extension of the second arcuate member; whereupon the flat plate could be bent over the remote edge of the first arcuate member and secured thereto. In the alternative, the flat plate member may comprise a separate element which is secured to the remote edges of the first and second arcuate members. In either case, however, the first and second arcuate members and the flat plate member are configured and connected so as to define an enlarged flat bottomed scoop-like member having a generally rectangular cross section at the end of the blade means which is remote from the handle.

Both the handle and the blade means are of rigid and inflexible construction, and each may be comprised entirely or partly of wood, plastic, metal or the like. The handle and blade means may be formed as integral unit, for example, by an injection molding technique. However, the handle and blade means normally would comprise several separate elements which are rigidly secured together by means of adhesive bonding, bolting, welding or the like.

The tool of the present invention would be gripped by the handle and the blade means would be inserted into a pail, can or some other container from which residual material is to be removed. The flat strip or scraping edge along the length of the blade means would be used to scrape any residual liquid, semi-liquid or semi-solid material from the inside walls of the container, with the material collecting in the trough defined by the remainder of the blade means. After the inside walls of the container have been scraped clean, the flat plate on the bottom of the scoop-like configuration on the remote end of the blade means could be used to scrape or scoop residual material from the bottom of the container. Thus, the tool of the present invention is suitable for scraping the inner surfaces of both the bottom and sidewall portions of a container notwithstanding the differences in shapes and contours thereof, all to the end that substantially all residual material can be removed.

The primary object of the present invention is to provide an improved hand tool for removing residual liquid, semi-liquid or semi-solid material from its container.

Another object is to provide a hand held tool for scraping and/or cleaning virtually any type of liquid, semi-liquid, semi-solid or solid material from the inner surfaces and bottom of the container in which the material is disposed.

Yet another object of the invention is to provide a hand tool, which can be made in various sizes and from various materials depending upon the particular application for which it is intended, which is adapted for removing residual liquid, semi-liquid or semi-solid material from its container.

Other objects and advantages of this invention will become apparent in view of the following detailed description of a preferred embodiment thereof, when taken in conjunction with the illustrative drawings, wherein.

DETAILED DESCRIPTION

Figure 1:
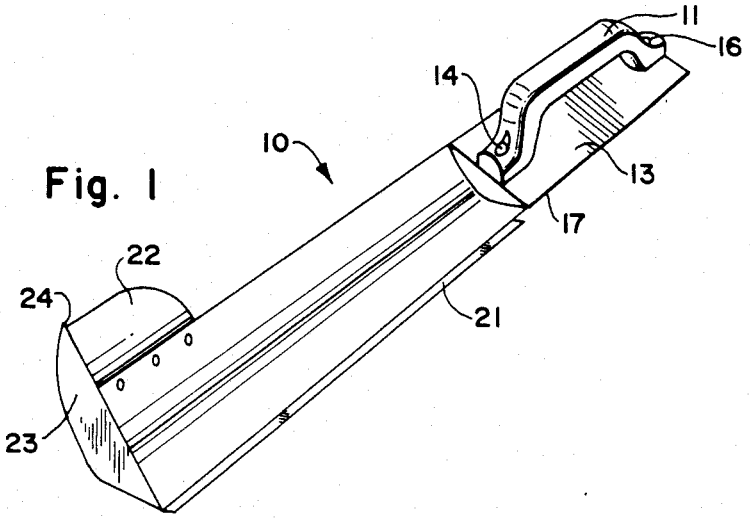
FIG. 1 is perspective view of one embodiment of the hand tool of the present invention for removing residual material from a container.

The hand held tool of the present invention is broadly denoted by the numeral 10. The tool includes a handle 11 and a blade means 11 which is connected to the handle and which extends generally longitudinally therefrom. The size and materials of construction of the handle and blade means are a matter of choice, depending primarily on the particular application for which the tool is intended. However, in most preferred aspects, the tool is comprised of wood, metal and/or plastic and is provided with a blade means that is sufficiently long so as to enable one to completely clean out a container, without placing the handle or a hand, or an arm or an elbow in the container that is being cleaned.

The tool illustrated in the drawings is particularly useful for removing, scraping, scooping and/or cleaning the contents of a container, usually but not limited to a metal or plastic pail or bucket, tub or tin, whether of circular, oval, square or other suitable cross-section. The tool is useful for removing all types of liquid, semi-liquid, semi-solid and solid materials including, but not limited to paint, butter, cream, sheet rock spakling compound, premixed plasters, ice-cream, jelly, nails, peanuts, cement, and so on.

In one particularly advantageous embodiment, the tool of this invention can be used in the construction industry for removing sheet rock spakling compound and/or premixed plasters from relatively large containers, such as a five gallon metal or plastic pail. For such applications, the tool 10 would be rigid and inflexible and would be provided with a wooden handle 11 which is bolted or otherwise fixedly secured to the blade means 12. As shown most clearly in FIG. 1, the handle 11 could be secured to a metal plate or bracket 13 by means of bolts 14, 16, and the bracket, in turn could be secured to the blade means 12. In one embodiment, the bracket 13 could be crimped to form a tight hem fitting 17. Alternatively, the bracket could be adhesively bonded, welded or otherwise permanently secured to the blade means.

Figure 5:
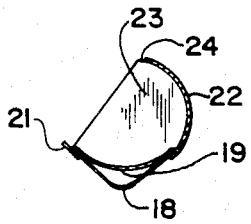
FIG. 5 is a cross-sectional view of the tool taken along line 5—5 of FIG. 2.
Figure 6:
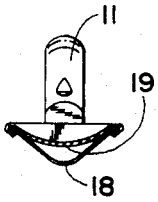
FIG. 6 is a cross-sectional view taken along line 6—6 of FIG. 2.

The blade means 12 preferably would be of a sufficient length so that when the end of the blade means that is remote from the handle is in contact with the bottom of the pail, the handle 11 and its bracket 13 would be outside of the pail. The blade means preferably would be formed from plastic or metal and would comprise a generally crescent-shaped cross-section having an outer curved or arcuate surface 18 of a lesser radius than the inner curved or arcuate surface 19. The blade means 12 could be solid in cross-section or hollow in cross-section as is shown in FIGS. 5 and 6. In one embodiment, the blade means 12 would be made from what is known as a turning vane, i.e., a 2-inch wide galvanized metal item which in section simulates a crescent shape.

While it is possible to use the longitudinal edges of the surfaces 18 and/or 19 as the scraping edges of the tool, it is generally preferred to attach a flat plate or strip 21, preferably of metal, along one longitudinal edge of the blade means 12 to serve as the scraping edge for the tool. In one embodiment the strip 21 would comprise a metal strip of approximately 0.025 inches in thickness, approximately 0.75 inches in width, and approximately 12 inches in length, i.e., about the contents depth of an average five gallon pail. The strip 21 would extend approximately one-third of its width beyond the edge of the blade means so as to function as a scraping edge for use along the inside walls of the pail or container.

Figure 2:
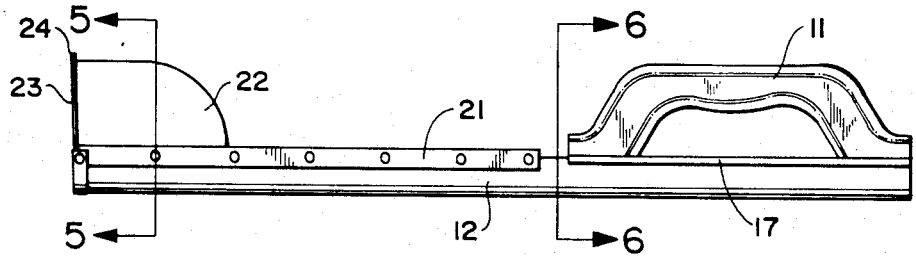
FIG. 2 is a front elevational view of the tool.
Figure 3:
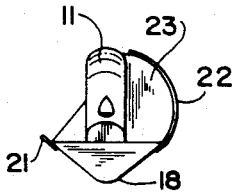
FIG. 3 is a right side elevational view of the tool.
Figure 4:
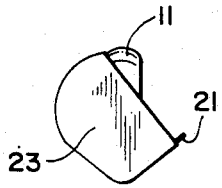
FIG. 4 is a left side elevational view of the tool.

The bottom or remote end of the blade means 12 is provided with a scoop-like member which is comprised of the remote end of the inner arcuate surface 19, the inner surface of an arcuate member 22 and the inner surface of a flat bottom scraper plate 23. In one embodiment, the arcuate member 22 and scraper plate 23 are comprised of a single sheet of metal which is suitably configured, bent and secured to the blade means, for example, by crimping and/or welding. In other embodiments, the arcuate member 22 and the bottom scraper plate 23 comprise separate elements which are suitably secured to the end of the blade means. The flat bottom plate 23 and the scraper strip 21 may be disposed at right angles to each other. However, since many containers have bottom surfaces which are slightly crowned, it is often preferred that the angle defined by the plane passing through the flat bottom 23 and the plane passing through the scraper strip 21 be slightly more or less than 90°, for example, between about 80° and about 100°, typically about 92°–98°. As can best be seen in FIG. 2, it is also preferred that the flat bottom plate 23 have a lip 24 which extends slightly beyond the edge of the arcuate member 22, e.g., about one-quarter of an inch or so, to facilitate the cleaning of that part of a pail where the side walls intersect the bottom of the pail.

In addition to being useful for scraping any residual material from the bottom of a container, the scoop-like member at the remote end of the tool can be used to scoop or collect fairly large amounts of material from a full or partially full container, for example, when it is desired to transfer material from one container to another. It will be appreciated that the relative ease with which material can be transferred from one container to another will depend, at least in part, on the volume of material that can be held in the scoop-like member. This volume, in turn, is determined by the relative size of the arcuate surface 19, the arcuate member 22, and the flat bottom plate 23; the sizes of these elements being variable as a matter of choice.

The tool of the present invention can be used in several ways to remove material from a container. For example, the tool may be held in the hand and the scoop-like member at the remote end thereof may be extended into a full or only partially full container to scoop out a volume of material. This is an important and useful feature of the tool of this invention since it enables a user to achieve a relatively rapid emptying of a large pail of material. Moreover, by using a tool having a scoop-like member of a preselected size and shape, one can scoop a preselected volume of material from a pail and deposit the same into another vessel, container or apparatus without fear of spilling or dropping the material, as would be the case when using a spoon or ladle to transfer the material. The tool, in its capacity as a scooper, is particular handy in transferring those semi-solid, semi-liquid materials that are used in the construction industry, such as premixed cements, plasters, adhesives, glues, and the like; or that are used in the food industry, such as butter, jellies, jams, and the like.

The tool may also be used, for example, with a simple clockwise circular motion of the wrist, to scrape residual material from the sides of a container. Conveniently, such a scraping action would be done in three or four partial passes, i.e., approximately one-third or one-fourth of the container would be scraped clean at one time, thus requiring three or four easy motions to clean the entire inside wall of a container. This scraping action would involve the manipulation of the flat strip or edge 21 against the inside walls of the container to be cleaned.

Finally, the tool could be used to scrape clean the bottom of the container. This would be accomplished by extending the blade means all the way down to the bottom of the container, and by using a simple motion of the wrist to scrape the flat plate 23 along the bottom thereof. The lip 24 on the flat plate 23 adjacent the arcuate member 22 would be used to scrape any remaining material from the bottom of the container where the bottom and the side walls thereof intersect.

It is to be understood that the above-described embodiments are simply illustrative of the principles of the invention. Thus, although the invention has been described particularly in connection with a tool for removing spakling compound from a five gallon pail, it is to be understood that the invention is not so limited and that it encompasses other similar tools for use in removing any type of liquid, semi-liquid, semi-solid or solid material from any container. It is to be understood, also, that various other modifications and changes may be devised by those skilled in the art which will embody the principles of the invention and fall within the spirit and scope thereof.

What is claimed is:

1. A hand tool for removing the contents of and for scraping clean a container for liquid, semi-liquid, semi-solid or solid materials, wherein the container has bottom and side walls, which comprises: an elongated handle member; and blade means connected to said handle member and extending generally longitudinally therefrom, said blade means including a first elongated arcuate member, a second arcuate member and a flat plate member, said first elongated arcuate member being connected adjacent one end thereof to said handle member and at the other end thereof to said flat plate member, said flat plate member being disposed generally transversely to the longitudinal extension of said blade means, said second arcuate member being connected to said first arcuate member and to said flat plate member so as to form a scoop-like member at the end of said blade means remote from said handle member, said scoop-like member being defined by the mutually adjacent surfaces of said first and second arcuate members and said flat plate member, said flat plate member including a first edge for scraping material from the bottom of the container, and said first arcuate member including a second edge for scraping material from the side walls of the container.

2. A tool as set forth in claim 1, wherein said second edge for scraping the side walls of the container extends along said first arcuate member all the way from said end thereof which is remote from said handle member to a point thereof adjacent said handle member so that substantially the entire length of said blade means from said handle member to said remote end thereof may be used for scraping material from the side walls of the container.

3. A tool as set forth in claim 1, wherein said second edge is formed on a strip member which is separate from said first arcuate member and wherein said strip member is fixedly connected along the length of said first arcuate member.

4. A tool as set forth in claim 3, wherein said second edge for scraping the side walls of the container extends along said first arcuate member all the way from said end thereof which is remote from said handle member to a point thereof adjacent said handle member so that substantially the entire length of said blade means from said handle member to said remote end thereof may be used for scraping material from the side walls of the container.

5. A tool as set forth in claim 3, wherein the angle of intersection between a plane passing through said strip member and a plane passing through said flat plate member is between about 80° and 100°.

6. A tool as set forth in claim 2, wherein the angle of intersection between a plane passing through said strip member and a plane passing through said flat plate member is between about 80° and 100°.

7. A tool as set forth in claim 5, wherein said angle of intersection is about 92° to 98°.

8. A tool as set forth in claim 6, wherein said angle of intersection is about 92° to 98°.

9. A tool as set forth in claim 7, wherein said flat plate member includes lip means extending beyond the line of intersection between said flat plate member and said second arcuate member, said lip means defining said first edge for scraping the bottom of the container.

10. A tool as set forth in claim 8, wherein said flat plate member includes lip means extending beyond the line of intersection between said flat plate member and said second arcuate member, said lip means defining said first edge for scraping the bottom of the container.

11. A tool as set forth in claim 9, wherein said second edge terminates at a point adjacent to said plane passing through said flat plate member at a point beyond the termination of said first edge of said flat plate in said plate.

12. A tool as set forth in claim 10, wherein said second edge terminates at a point adjacent to said plane passing through said flat plate member at a point beyond the termination of said first edge of said flat plate in said plane.

13. A tool as set forth in claim 11, further including bracket means, wherein said handle member is secured to said bracket means, and wherein said bracket means is secured to said blade means.

14. A tool as set forth in claim 12, further including bracket means, wherein said handle member is secured to said bracket means, and wherein said bracket means is secured to said blade means.

15. A tool as set forth in claim 13, wherein said blade means comprises a crescent-shaped cross-section having an outer curved surface and an inner curved surface and wherein said outer curved surface has a lesser radius than said inner curved surface.

16. A tool as set forth in claim 14, wherein said blade means comprises a crescent-shaped cross-section having an outer curved surface and an inner curved surface and wherein said outer curved surface has a lesser radius than said inner curved surface.

* * * * *